US006708859B2

(12) United States Patent
Kleinschnitz

(10) Patent No.: US 6,708,859 B2
(45) Date of Patent: Mar. 23, 2004

(54) DEVICE FOR INFEEDING A WEB

(75) Inventor: Andreas Josef Kleinschnitz, Leinach (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 12 days.

(21) Appl. No.: 10/111,402

(22) PCT Filed: Jan. 22, 2001

(86) PCT No.: PCT/DE01/00248

§ 371 (c)(1),
(2), (4) Date: May 6, 2002

(87) PCT Pub. No.: WO01/56790

PCT Pub. Date: Aug. 9, 2001

(65) Prior Publication Data

US 2002/0175198 A1 Nov. 28, 2002

(30) Foreign Application Priority Data

Feb. 2, 2000 (DE) ..... 100 04 482

(51) Int. Cl.[7] ..... B41F 13/03
(52) U.S. Cl. ..... 226/91
(58) Field of Search ..... 226/110, 91, 172, 226/179, 19, 92; 101/228, 232

(56) References Cited

U.S. PATENT DOCUMENTS 4,158,846 A * 6/1979 Gordon ..... 226/110
4,807,791 A * 2/1989 Cho ..... 226/19
5,087,185 A * 2/1992 Yada et al. ..... 226/100
5,108,210 A * 4/1992 Hirano et al. ..... 226/110
5,263,414 A 11/1993 Lehrrieder et al.
5,605,709 A * 2/1997 Morimoto et al. ..... 226/91
5,806,745 A * 9/1998 Irwin ..... 226/179
6,038,973 A 3/2000 Marmin
6,041,991 A * 3/2000 Mehri et al. ..... 226/110
6,269,751 B1 8/2001 Hauck et al.

FOREIGN PATENT DOCUMENTS

| | | |
|---|---|---|
| DE | 2 241 127 | 3/1974 |
| DE | 92 14 808.5 | 3/1993 |
| DE | 198 16 510 A1 | 1/1999 |
| DE | 197 18 548 C2 | 9/1999 |

* cited by examiner

*Primary Examiner*—Kathy Matecki
*Assistant Examiner*—Scott J. Haugland
(74) *Attorney, Agent, or Firm*—Jones, Tullar & Cooper, P.C.

(57) ABSTRACT

A paper web draw-in device for a rotary printing press includes a plurality of guides that support a web draw-in cable or chain. The guides are adjustable in a direction transverse to the web conveying direction. Different positions of these guides can be set in response to the widths of various webs being drawn into the rotary printing press.

6 Claims, 1 Drawing Sheet

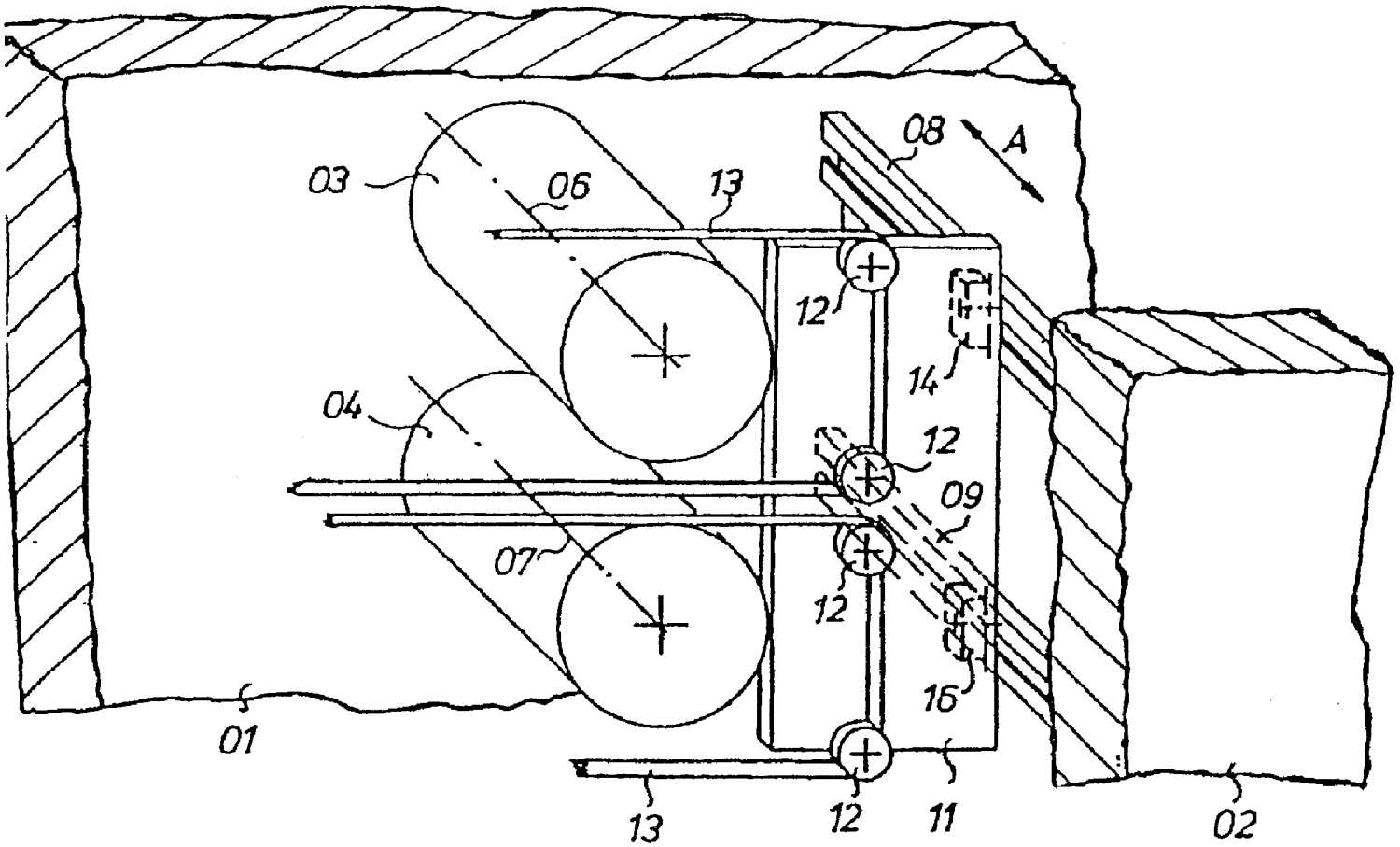
A
08
02
14
12
09
16
11
12
12
12
13
13
06
07
03
04
01

DEVICE FOR INFEEDING A WEB

FIELD OF THE INVENTION

The present invention is directed to a device for drawing in a web in a printing press. A web draw-in device is supported by a guide. This guide can be moved to divert the draw-in device transversely with respect to the conveying direction of the web.

BACKGROUND OF THE INVENTION

It is generally known to fasten or to mount guide devices for paper web draw-in devices, for example guide devices for paper web draw-in devices such as cables, belts or roller chains to the inside of at least one of the lateral frames of a web-fed rotary printing press. For example, in DE-OS 22 41 127 the guide devices are fastened to the inside of the lateral frame by the use of forked supports.

SUMMARY OF THE INVENTION

The object of the present invention is directed to providing a device for drawing in a web.

The object is attained in accordance with the invention by providing guide devices that support the web draw-in device. These guide devices are supported so that they can move transversely with respect to the conveying direction of the web.

The advantages which can be achieved by the present invention lie, in particular, in creating a guide device for paper web draw-in devices which can be adapted to the width of the roll changer. In the course of this, holders for the guide devices can be adjusted in such a way that the alignment of the guide devices and thus of the paper web draw-in devices is in agreement with the paper web width.

BRIEF DESCRIPTION OF THE DRAWINGS

A preferred embodiment of the present invention is represented in the sole drawing and will be described in greater detail in what follows.

The sole drawing show a perspective representation of a device in accordance with the present invention for the axial adjustment of guide devices for paper web draw-in devices.

DESCRIPTION OF THE PREFERRED EMBODIMENTS

Rollers 03, 04, which may be, for example, paper guide rollers, are rotatably seated between lateral frames 01, 02 of a web-fed rotary printing press. Spaced-apart guide rails 08, 09, which point in a direction parallel to the direction A of the axes of rotation 06, 07 of rollers 03, 04, are fastened on at least one lateral frame 02. The guide rails 08, 09 can, for example, consist of C-shaped profiled sections and, as depicted in the sole drawing, can also be embodied traverse-like between both lateral frames 01, 02.

Slidable crossheads, which are not specifically represented in the sole drawing, are provided with threaded bores. These slidable crossheads are arranged in the C-shaped profiled sections of the guide rails 08, 09.

A holder 11, which can be infinitely variably displaced in the axis parallel direction A, is supported by the guide rails 08, 09. Holder 11 supports one or several guide devices 12, such as, for example, guide rollers 12, which guide rollers 12 are used for receiving or diverting a paper web draw-in device 13. The paper web draw-in device 13 may be, for example, a belt system which can be pulled forward and back.

The holder 11 can consist of, for example, a plate which has brackets 14, 16 facing in the axis-parallel direction A, and through which the plate-shaped holder 11 is in connection, by the use of holding screws, which are not specifically represented, with the slidable crossheads of the guide rail 08, 09. In this way, the paper draw-in devices 13 are arranged to be slidable in the axis-parallel direction A in respect to a lateral edge of a paper web, not represented, which is to be drawn in.

The draw-in device 13 is arranged, in a first position, in the vicinity of a lateral edge of a first web of a first width, and the draw-in device 13 can be arranged, in a second position, in the vicinity of a lateral edge of a second web of a second width.

Each of the holders 11 can receive the guide devices 12 for one or for several paper draw-in devices 13, as shown in the sole drawing figure.

The guide devices 12 can also consist of curved C-shaped hollow profiled sections for receiving a finite length paper draw-in device 13, for example a roller chain.

The start of a paper web to be drawn into the press is fastened in a known manner to the paper web draw-in device 13. The paper web draw-in device 13 is guided by the guide devices 12, supported by the holder 11, to turn through approximately 180° about the paper web guide roller 03, 04 with which each paper web draw-in device 13 cooperates.

While a preferred embodiment of a device for infeeding a web in accordance with the present invention has been set forth fully and completely hereinabove, it will be apparent to one of skill in the art that various changes in, for example the drive for the draw-in devices, the type of printing press used, and the like could be made without departing from the true spirit and scope of the present invention which is accordingly to be limited only by the following claims.

What is claimed is:

1. A device for drawing in a web comprising:

first and second laterally spaced frames;

at least one web guide roller supported between said first and second frames for rotation about an axis of rotation;

a web draw-in belt adapted to draw in a web along a web conveying direction about said at least one web guide roller;

at least two web draw-in belt guide devices positioned for supporting said web draw-in belt adjacent said at least one web guide roller, said at least two web draw-in belt guide devices being positioned to cause said web draw-in belt to turn through 180° about said at least one web guide roller;

a holder, said holder supporting said at least two web draw-in belt guide devices; and at least a first guide rail extending between said first and second laterally spaced frames parallel to said web guide roller axis of rotation, said at least first guide rail supporting said holder, said holder being movable along said at least one guide rail in a direction of movement parallel to said web guide roller axis of rotation.

2. The device of claim 1 wherein each of said at least two web draw-in belt guide devices is a roller.

3. The device of claim 1 wherein said at least first guide rail has a C-shaped cross-section.

4. The device of claim 1 further including a second guide rail spaced from and extending parallel to said first guide rail and cooperating with said first guide rail to support said holder.

5. The device of claim 4 further including a first bracket slidable in said first guide rail and a second bracket slidable in said second guide rail, said first and second brackets extending between said holder and said first and second guide rails.

6. The device of claim 1 further including a bracket slidable in said at least first guide rail and extending between said holder and said at least first guide rail.

* * * * *